US006448500B1

(12) United States Patent
Hosaka et al.

(10) Patent No.: US 6,448,500 B1
(45) Date of Patent: Sep. 10, 2002

(54) BALANCED TRANSMISSION SHIELDED CABLE

(75) Inventors: Taiji Hosaka; Hiroshi Takenoshita, both of Yokohama (JP)

(73) Assignee: J. S. T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 09/959,730

(22) PCT Filed: May 11, 2000

(86) PCT No.: PCT/JP00/03045

§ 371 (c)(1),
(2), (4) Date: Nov. 5, 2001

(87) PCT Pub. No.: WO00/70626

PCT Pub. Date: Nov. 23, 2000

(30) Foreign Application Priority Data

May 13, 1999 (JP) ..... 11-132953

(51) Int. Cl.[7] ..... H01B 7/34
(52) U.S. Cl. ..... 174/113 R
(58) Field of Search ..... 174/113 R, 36, 174/116, 27

(56) References Cited

U.S. PATENT DOCUMENTS 2,072,712 A * 3/1937 Fishcher ..... 174/36
4,755,629 A * 7/1988 Beggs et al. ..... 174/115
4,800,236 A 1/1989 Lemke
5,149,915 A * 9/1992 Brunker et al. ..... 174/105 R
5,834,699 A * 11/1998 Buck et al. ..... 174/113 R

FOREIGN PATENT DOCUMENTS

| | | |
|---|---|---|
| EP | 0182 435 | 11/1985 |
| JP | UM57-179211 | 5/1981 |
| JP | UM06-72119 | 10/1994 |
| JP | 07-153324 | 6/1995 |
| JP | 10-247425 | 9/1998 |

OTHER PUBLICATIONS

English Language Written Opinion and International Preliminary Examination Report.

* cited by examiner

*Primary Examiner*—Chau N. Nguyen
(74) *Attorney, Agent, or Firm*—Rader, Fishman & Grauer, PLLC

(57) ABSTRACT

A balanced transmission shielded cable includes an inner conductive shield (3) and an outer conductive shield (5) surrounding the inner conductive shield (3). In an annular region (A) defined between both shields (3, 5), unshielded twisted pairs (4) for signal transmission and shielded drain lines (6) are alternately disposed in annular array. The shielded drain lines (6) contact both shields (3, 5) and are led outside and grounded. Both shields (3, 5) surrounding the twisted pairs (4) and the shielded drain lines (6, 6) keep a substantially uniform distance with respect to conductive lines constituting the twisted pairs (4).

5 Claims, 4 Drawing Sheets

PRIOR ART

BALANCED TRANSMISSION SHIELDED CABLE

TECHNICAL FIELD

The present invention relates to a balanced transmission shielded cable comprising a plurality of unshielded twisted pair wires for signal transmission and used for signal transmission between boards of electronic equipment, for example.

BACKGROUND ART

A shielded cable is used as a transmission line for transmitting a signal using a plurality of conductive lines physically separated over its entire length and electromagnetically insulated. Examples of the shielded cable include a cable used for a local area network (LAN) and a cable used for internal wiring or external wiring of a personal computer. Found as this type of cable is one capable of achieving a higher data transmission speed (a transmission speed of several tens of megabytes per second to 650 megabytes per second, for example).

A system for transmitting low voltage differential signaling (hereinafter merely referred to as LVDS) using unshielded twisted pair wires has been proposed. In the LVDS transmitting system, high-speed switching is possible by reducing the amplitude of a signal, thereby making it possible to increase the transmission rate. On the other hand, a coaxial cable is high in cost, and can provide only unbalanced transmission. Accordingly, it cannot be used for LVDS transmission.

FIG. 4 illustrates a conventional balanced transmission shielded cable. Referring to FIG. 4, six pairs of balanced unshielded twisted pair wires 31 for signal transmission and power supply pair wires 32 are contained in a shielded conductor 33. The shielded conductor 33 is covered with an insulating external coating 34. The power supply pair wires 32 are disposed at the center of the structure of the cable, and the six twisted pair wires 31 are disposed in an annular array around the power supply pair wires 32. Each of the twisted pair wires 31 is formed by twisting paired conductive lines coated with an insulator 35. Reference numeral 36 denotes a circle indicated by a broken line representing an outer shape of the twisted pair wires 31, and reference numeral 37 denotes a circle indicated by a broken line representing an outer shape of the power supply pair wires 32. The shielded conductor 33 is composed of braided wires, for example, and is led out of the cable at its end and is grounded.

The cable shown in FIG. 4 has the advantage in that the structure is simple because the power supply pair wires 33 and the plurality of twisted pair wires 31 are collectively shielded by the single shielded conductor 33. However, the distance from the conductive lines composing the twisted pair wires 31 to the shielded conductor 33 and the distance from the conductive lines to the conductive lines composing the other twisted pair wires are non-uniform along the length of the cable, so that a stable impedance is not obtained. Therefore, it is difficult to reduce crosstalk between the twisted pair wires 31 for signal transmission.

On the other hand, a method of shielding each of the twisted pair wires to seal its electric field and magnetic field has been considered. In this case, the fabrication cost is high. Further, all a resistance, a capacitance, and an inductance are changed, and all of them increase the transmission loss. For example, a transmitted signal may, in some cases, be decayed to no less than three times that in the same unshielded pairs.

The present invention has been made in view of the above-mentioned problem and has for its object to provide a balanced transmission shielded cable in which crosstalk hardly occurs.

DISCLOSURE OF INVENTION

In order to attain the above-mentioned object, a preferred mode of the present invention is characterized by comprising an inner conductive shield; an outer conductive shield surrounding the inner conductive shield; an annular region defined between the inner conductive shield and the outer conductive shield; a plurality of unshielded twisted pair wires for signal transmission each constructed by twisting paired conductive lines coated with an insulator; and a plurality of shielded drain lines for grounding the inner conductive shield and the outer conductive shield in contact with the shields, the unshielded twisted pair wires and the shielded drain lines being contained in the annular region and alternately disposed in an annular array with one or more of them as a unit along the annular region.

In the present embodiment, the shielded drain lines in contact with the inner and outer conductive shields are interposed between the adjacent twisted pair wires, thereby making it possible to surround each of the twisted pair wires over the entire length of the cable by grounded conductors (that is, both the shielded drain lines between which both the conductive shields and the twisted pair wires are interposed), and to make the distance from the conductive lines composing the twisted pair wires to the shields approximately uniform over the entire length of the cable. Consequently, a stable impedance can be ensured with respect to the twisted pair wires for signals over the entire length of the cable, and crosstalk can be reduced.

When the unshielded twisted pair wires and the shielded drain lines are alternately disposed in an annular array with more than one of them as a unit, the crosstalk between the twisted pair wires for signals slightly remains in the same pair. However, the crosstalk can be significantly reduced as a whole.

It is preferable that the shielded drain line comprises a core composed of molded synthetic resin and a conductive layer composed of a plating layer formed on a surface of the core. In this case, it is possible to make the shielded cable lightweight through lighter weight of the shielded drain line.

When the shielded drain line composed of a copper line, for example, is used, the cross-sectional shape of the twisted pair wires on both sides of the shielded drain line is deformed so as to be partially depressed. Consequently, electrical and structural balance between both the conductive lines composing the twisted pair wires may be upset.

Contrary to this, in the present embodiment, when a soft product is employed as a resin molded product of the shielded drain line, a part of the contour of the cross section of the shielded drain line is deformed so as to be depressed, and the twisted pair wires are not deformed. As a result, electrical and structural balance between the conductive lines composing the twisted pair wires is maintained, thereby making it possible to further reduce crosstalk. It is possible to take, as an example of the plating layer composing the conductive layer, one containing nickel or tin. Further, gold can be also used. In order to reduce the cost, however, the thickness of the conductive layer is forced to be small, so that conductive characteristics may be degraded. It is possible to take, as an example of resin forming the core, alamide resin. The conductive layer composed of the plating layer can be easily formed using so-called MID (Molded Interconnection Device).

It is preferable that the inner conductive shield surrounds the power supply pair wires insulated and coated. In this case, a portion between the power supply pair wires and the plurality of twisted pair wires for signals is shielded with the inner conductive shield, thereby making it possible to prevent interference therebetween. Further, a hybrid shielded cable in which crosstalk hardly occurs can be realized at low cost in a simple configuration by supplying power and signals.

BEST MODE FOR CARRYING OUT THE INVENTION

An embodiment of the present invention will be described with reference to accompanying drawings.

Figure 1:
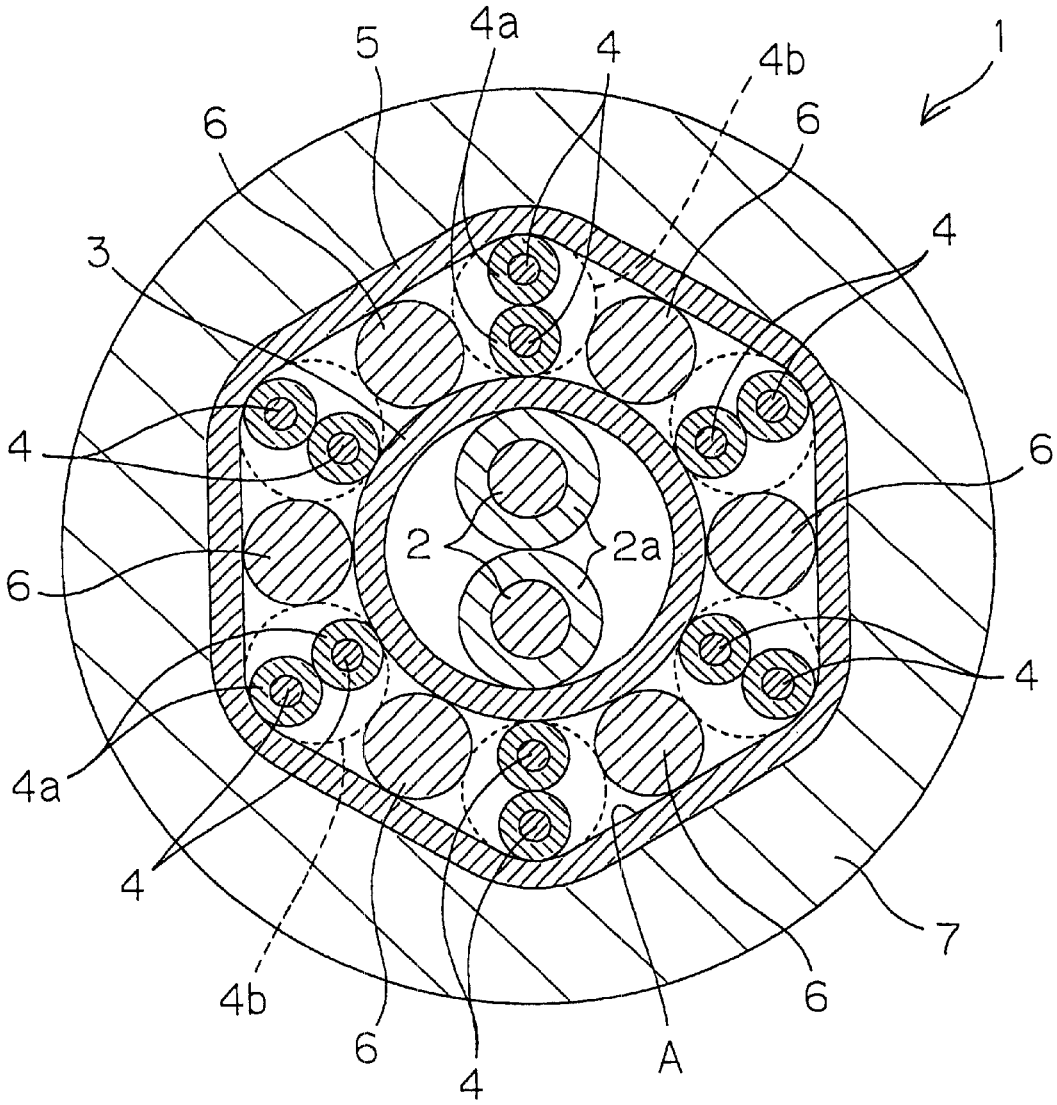
FIG. 1 is a cross-sectional view of a balanced transmission shielded cable according to a first embodiment of the present invention.

FIG. 1 is a cross-sectional view of a balanced transmission shielded cable used for LVDS transmission in a first embodiment of the present invention. Referring to FIG. 1, a shielded cable 1 has power supply pair wires 2 disposed at the center of its cross section, and the power supply pair wires 2 are surrounded by an inner conductive shield 3. Each of the power supply pair wires 2 is constructed by twisting paired conductive lines coated with an insulator 2*a* at a predetermined twisting pitch. The outer shape of the power supply pair wires 2 which have been thus subjected to insulation and coating processing is represented as a cross-sectional twisted shape indicated by a circle which is overlapped with an inner peripheral surface of the inner conductive shield 3.

A plurality of unshielded twisted pair wires 4 are disposed in an annular array around the inner conductive shield 3, and are further surrounded by an outer conductive shield 5. The outer conductive shield 5 is further coated with an insulating outer coating 7. Each of the twisted pair wires 4 is constructed by twisting paired conductive lines coated with an insulator 4*a* at a predetermined twisting pitch. In the drawing, a circle 4*b* indicated by a broken line is in an outer shape of the twisted pair wires 4 represented as a cross-sectional twisted shape.

Reference numeral 6 denotes a shielded drain line for grounding the inner conductive shield 3 and the outer conductive shield 5 in contact with the shields. The shielded drain lines 6 and the twisted pair wires 4 are alternately disposed with one of them as a unit in an annular region A defined between the inner conductive shield 3 and the outer conductive shield 5.

It is possible to take, as examples of the inner conductive shield 3 and the outer conductive shield 5, conductive braided wires composed of tin-plated annealed copper and an aluminum foil affixed to polyester.

It is possible to take, as an example of the shielded drain line 6, a conductive line of AWG40 (0.09 mm in diameter obtained by twisting seven cores each having a diameter of 0.03 mm).

According to the present embodiment, the shielded drain line 6 in contact with both the inner and outer conductive shields 3 and 5 is interposed between the adjacent twisted pair wires 4. Consequently, all sides of each of the twisted pair wires 4 can be surrounded by the inner conductive shield 3, the outer conductive shield 5, and the pair of shielded drain lines 6 over the entire length of the shielded cable 1. Moreover, the distance from the conductive lines composing the twisted pair wires 4 to grounded conductors (corresponding to both the shields 3 and 5 and both the shielded drain lines 6) can be made approximately uniform. As a result, a stable impedance can be ensured with respect to the twisted pair wires 4 over the entire length of the shielded cable 1, thereby making it possible to reduce crosstalk between signal lines composed of the twisted pair wires 4.

Furthermore, a portion between the power supply pair wires 2 and the plurality of twisted pair wires 4 for signals is shielded with the inner conductive shield 3, thereby making it possible to prevent interference therebetween. A hybrid shielded cable 1 in which crosstalk hardly occurs can be realized at low cost in a simple configuration by supplying power and signals.

Figure 2:
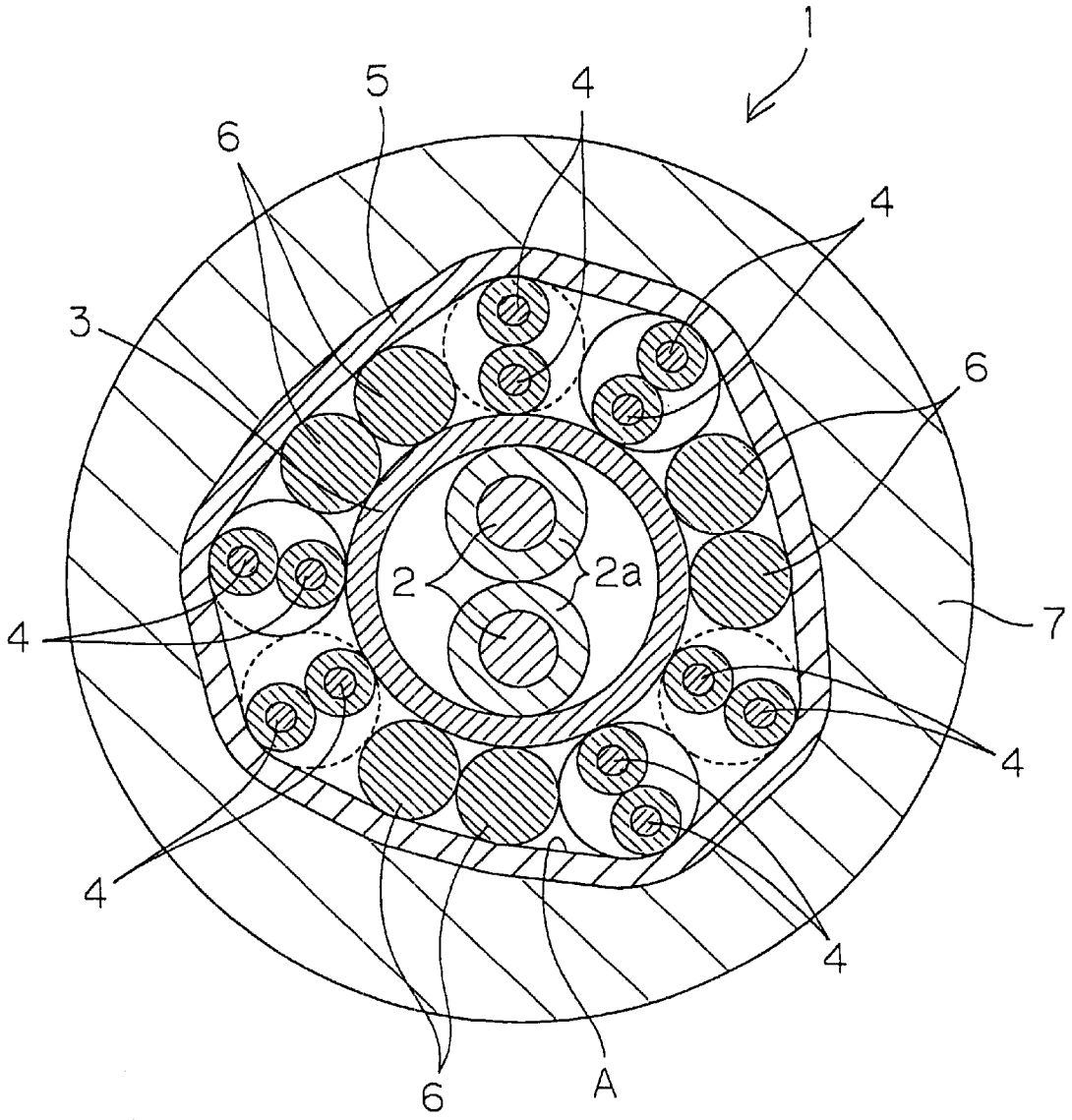
FIG. 2 is a cross-sectional view of a balanced transmission shielded cable according to a second embodiment of the present invention.
Figure 4:
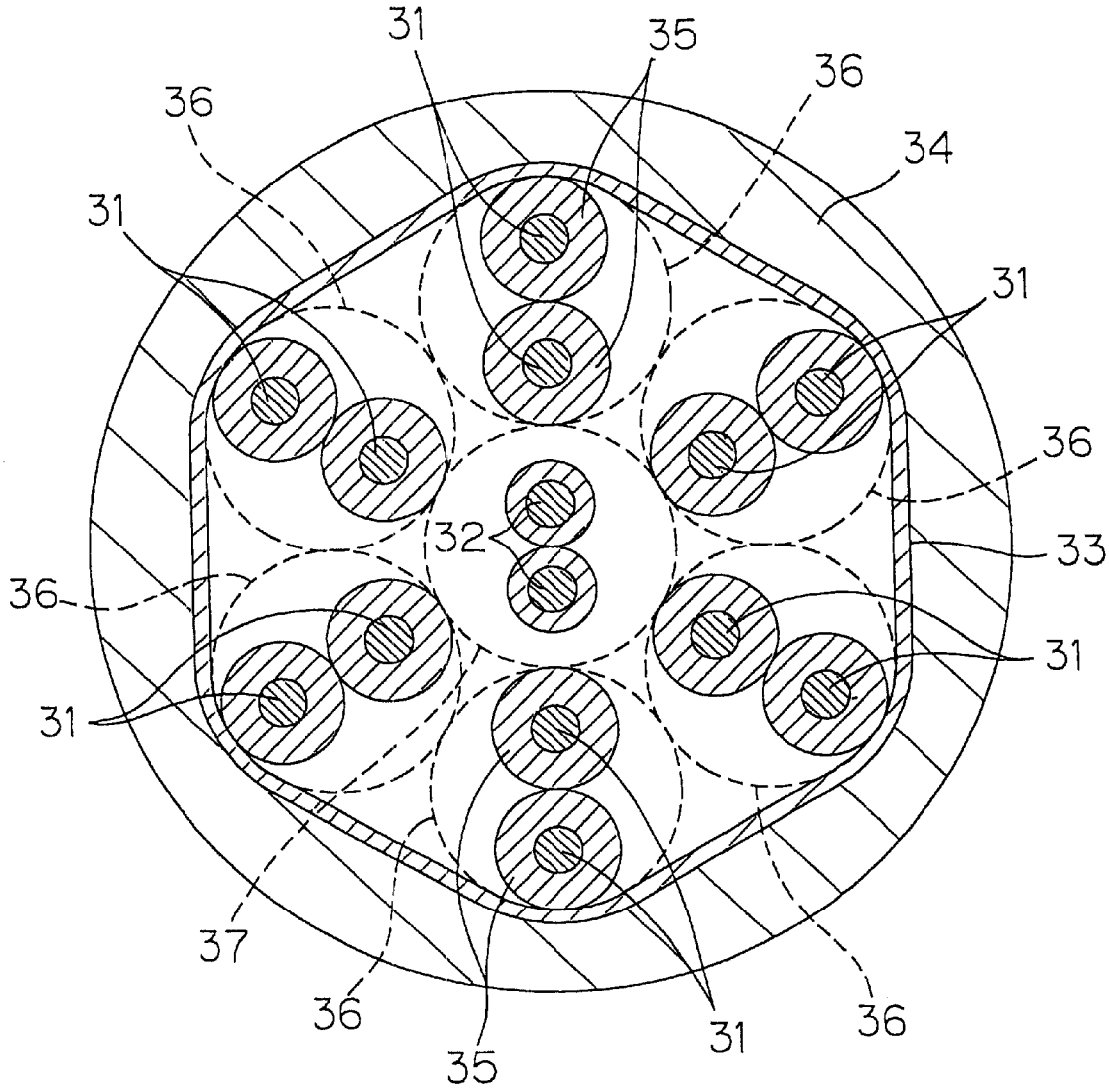
FIG. 4 is a cross-sectional view of a conventional shielded cable.

Then, FIG. 2 is a cross-sectional view of a shielded cable according to a second embodiment of the present invention. Referring to FIG. 2, the second embodiment differs from the first embodiment in that the twisted pair wires 4 and the shielded drain lines 6 are alternately disposed with one of them as a unit in the first embodiment, while being alternately disposed with more than one (two, for example) of them as a unit in the second embodiment. In this case, crosstalk between the twisted pair wires 4 in the same pair slightly remains. However, the overall crosstalk can be significantly made lower, as compared with that in the conventional example shown in FIG. 4.

Figure 3A:
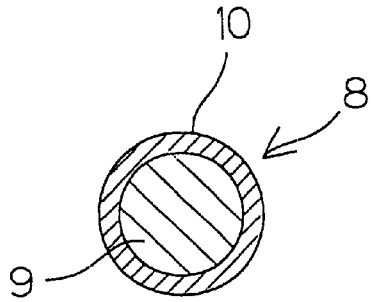
FIGS. 3A and 3B are cross-sectional views of a shielded drain line according to a third embodiment of the present invention.
Figure 3B:
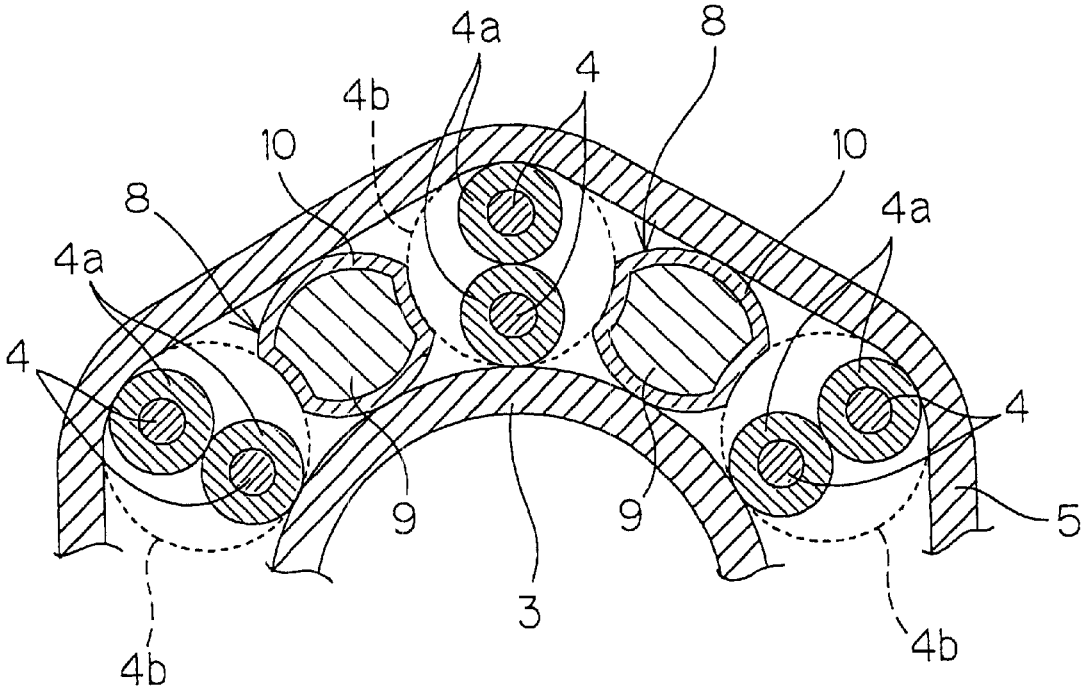

Then, FIGS. 3A and 3B are respectively a cross-sectional view of a shielded drain line in a third embodiment of the present invention and a cross-sectional view of a principal part of a shielded cable. The third embodiment is obtained by changing only the shielded drain line from that in the first embodiment.

As shown in FIG. 3A, a shielded drain line 8 in the third embodiment is constructed by forming a conductive layer 10 composed of a plating layer on a surface of a core 9 composed of synthetic resin injection molded. It is possible to take, as an example of the plating layer composing the conductive layer 10, one containing nickel, tin, or gold. It is possible to take alamide resin as an example of resin forming the core 9. The conductive layer 10 composed of the plating layer can be easily formed using a so-called MID (Molded Interconnection Device) technique.

According to the third embodiment, it is possible to make the shielded cable lightweight through lighter weight of the shielded drain line 8 using resin. Further, when a soft core is employed as the core 9 composed of a resin molded product in the shielded drain line 8, a part of the contour of a cross section of the shielded drain line 8 is deformed so as to be depressed, as shown in FIG. 3B, when a pressing force is exerted between the shielded drain line 8 and twisted pair wires 4, and the twisted pair wires 4 are not deformed. As a result, electrical and structural balance between conductive lines composing the twisted pair wires 4 is maintained, thereby making it possible to further reduce crosstalk.

The present invention is not limited to each of the above-mentioned embodiments. For example, the shielded drain line in the third embodiment is also applicable to the second embodiment. In addition thereto, various modifications can be made in the range of the present invention.

What is claimed is:

1. A balanced transmission shielded cable characterized by comprising:

an inner conductive shield;

an outer conductive shield surrounding the inner conductive shield;

an annular region defined between the inner conductive shield and the outer conductive shield;

a plurality of unshielded twisted pair wires for signal transmission each constructed by twisting paired conductive lines coated with an insulator; and a plurality of shielded drain lines for grounding the inner conductive shield and the outer conductive shield in contact with the shields, the unshielded twisted pair wires and the shielded drain lines being contained in the annular region and alternately disposed in an annular array with one or more of them as a unit along the annular region.

2. The balanced transmission shielded cable according to claim 1, characterized in that at least one of the shielded drain lines comprises a core composed of molded synthetic resin and a conductive layer composed of a plating layer formed on a surface of the core.

3. The balanced transmission shielded cable according to claim 2, characterized in that a part of the contour of a cross section of the shielded at least one drain line is depressed upon being pressed by the adjacent unshielded twisted pair wires.

4. The balanced transmission shielded cable according to claim 1, characterized in that the inner conductive shield surrounds power supply pair wires insulated and coated.

5. The balanced transmission shielded cable according to claim 1, characterized in that a low-voltage operation signal is caused to flow through the unshielded twisted pair wires.

* * * * *